US005256318A

United States Patent [19]

Masutani et al.

[11] Patent Number: 5,256,318

[45] Date of Patent: Oct. 26, 1993

[54] LEATHER TREATMENT AND PROCESS FOR TREATING LEATHER

[75] Inventors: Tetsuya Masutani; Masahiko Maeda; Norio Yanagisawa; Masato Kuroi, all of Osaka, Japan

[73] Assignee: Daikin Industries Ltd., Osaka, Japan

[21] Appl. No.: 679,959

[22] Filed: Apr. 3, 1991

[30] Foreign Application Priority Data

Apr. 7, 1990 [JP] Japan ..... 2-92951

[51] Int. Cl.[5] ..... C14C 3/02

[52] U.S. Cl. ..... 252/8.570; 8/94.1 R; 8/94.2; 8/94.25; 8/94.27; 8/94.29; 8/436

[58] Field of Search ..... 8/94.26, 94.1 R, 94.2, 8/94.25, 94.27, 94.29, 436; 252/8.57

[56] References Cited

U.S. PATENT DOCUMENTS

| | | | |
|---|---|---|---|
| 3,094,547 | 6/1963 | Heine | 558/175 |
| 3,385,812 | 5/1968 | Brachman | 524/144 |
| 3,661,631 | 5/1972 | Plapper et al. | 252/8.57 |
| 4,525,305 | 6/1985 | Patel | 252/8.57 |
| 4,539,006 | 9/1985 | Langford | 252/8.57 |
| 4,781,844 | 1/1988 | Kortmann et al. | 252/8.57 |
| 5,098,446 | 3/1992 | Rodriguez et al. | 8/94.26 |

FOREIGN PATENT DOCUMENTS 386044 2/1958 Fed. Rep. of Germany

*Primary Examiner*—Jacqueline V. Howard

*Attorney, Agent, or Firm*—Birch, Stewart, Kolasch & Birch

[57] ABSTRACT

A tanned leather treated with a fatliquoring agent in combination with a fluorine-containing oil, which has good touch, water resistance, water- and oil-repellency, washing resistance, and which is not discolored or faded by dry cleaning.

32 Claims, No Drawings

LEATHER TREATMENT AND PROCESS FOR TREATING LEATHER

BACKGROUND OF THE INVENTION

1. Field of the Invention

The present invention relates to a leather treatment and a process for treating leather. In particular, the present invention relates to a leather treatment comprising a fluorine-containing oil and a process for treating a leather with the leather treatment.

2. Description of the Related Art

Recently, to improve touch and flexibility of a fatliquored and tanned leather, a natural or synthetic oil is used together with a fatliquoring agent in a fatliquoring step of the leather. However, articles produced from such treated leather, for example leather clothes, are discolored or faded by dry cleaning using perchloroethylene (Perclene) or a petroleum solvent. A cause for this may be extraction of the oil which is added in the fatliquoring step.

SUMMARY OF THE INVENTION

One object of the present invention is to provide a leather treatment composition which provides a leather having good touch, water resistance, water- and oil-repellency and washing resistance, that is not discolored or faded by dry cleaning.

Another object of the present invention is to provide a process for treating a leather with said leather treatment composition.

According to a first aspect of the present invention, there is provided a leather treatment composition comprising a fatliquoring agent and a fluorine-containing oil.

According to a second aspect of the present invention, there is provided a process for treating a leather comprising treating a leather with a leather treatment composition which comprises a fatliquoring agent and a fluorine-containing oil in a fatliquoring treatment.

According to a third aspect of the present invention, there is provided a process for treating a leather comprising fatliquoring a leather and then treating the fatliquored leather with a fluorine-containing oil.

DETAILED DESCRIPTION OF THE INVENTION

The fluorine-containing oil should be a stable oil, and includes a perfluoropolyether comprising repeating units of the formula:

$$-(\overset{\overset{\displaystyle CF_3}{|}}{C}FCF_2O)-$$

(e.g. KRYTOX (trademark) manufactured by E. I. DuPont), a perfluoropolyether comprising repeating units of the formula:

$$-(\overset{\overset{\displaystyle CF_3}{|}}{C}FCF_2O)_p-(CF_2O)_q-(\overset{\overset{\displaystyle CF_3}{|}}{C}FO)_r-$$

wherein p, q and r are integers a sum of which is not smaller than 2 and not larger than 200 (e.g. FOMBLIN (trademark) manufactured by Montedison), a polyfluoroether comprising repeating units of the formula:

$$-(CH_2CF_2CF_2O)_a-(CHClCF_2CF_2O)_b-(CCl_2CF_2CF_2O)_c-(CHFCF_2CF_2O)_d-(CFClCF_2CF_2O)_e-(CF_2CF_2CF_2)_f-$$

wherein a, b, c, d, e and f are 0 or positive integers and satisfy the equation's $2 \leqq a+b+c+d+e+f \leqq 200$ and $a+c+d+f \geqq 1$ (e.g. DEMNUM (trademark) manufactured by Daikin Industries Limited), and a compound comprising repeating units of the formula:

$$-(CF_2CFCl)_n-$$

(e.g. DAIFLOYL (trademark) manufactured by Daikin Industries Limited). Among them, a compound a molecular end of which is modified with a carboxyl group or a phosphate group is preferred.

The fatliquoring agent to be used in the present invention may be any of conventionally used fatliquoring agents. The fatliquoring agents are roughly classified as a emulsion type and a non-emulsion type. The emulsion type fatliquoring agents include anionic type such as sulfated oil, sulfited oil, sulfonated oil, soap, phosphated oil and aliphatic acid condensate base oil; cationic types such as aliphatic acid amine base oil; amphoteric types such as aminocarboxylic acid base oil and betaine compounds; and nonionic types such as polyethylene oxide derivatives. The non-emulsion type fatliquoring agents include natural oils such as fish oil, beef tallow oil, vegetable oil (e.g. olive oil), animal oil (e.g. beef tallow, lard and mutton tallow), wool grease, mineral oil, wax, paraffin wax and the like. In addition, a synthetic oil base fatliquoring agent or a reactive oil may be used. As a modified oil, oxidative polymerized oil and moellon degras are exemplified.

In a preferred embodiment, a fatliquoring agent is used having a functional group which is reactive with a metal compound included in the tanned leather to form a complex or a double salt (e.g. a carboxyl group, a phosphate ester group, a phosphonic acid group, a phosphinic acid group, a sulfuric acid group, a sulfurous acid group, a sulfonic acid group, an ammino group etc.).

In a more preferred embodiment, as the fatliquoring agent, a phosphate ester, phosphonic acid derivative or phosphinic acid derivative having a fluoroalkyl group, a fluoroalkenyl group or a fluoroether group, or their ammonium salt, alkali metal salts or alkaline earth metal salts; reaction products of the above fluorine-containing phosphorus base compound (the above phosphate ester, phosphonic acid derivative or phosphinic acid derivative) with a metal compound except the alkali and alkaline earth metals can be used independently or as a mixture with the above fatliquoring agent or other components. In addition, fluorine-containing carboxylic acids or their salts as well as fluorine-containing surfactants are preferably used as the fatliquoring agents.

The metal compound which is reacted with the phosphorus base compound may be any metal compound that can react with the phosphoric acid group to form a complex or a double salt and includes all metal compounds except compounds of the alkali and alkaline earth metals. Examples are chromium compounds, zirconium compounds, titanium compounds, aluminum compounds, thallium compounds, zinc compounds and the like, for example, salts, oxides, sulfides, halides and hydroxides thereof which are soluble in organic or inorganic solvents.

In a preferred embodiment, the compounds may be any one that can be dissolved in a reaction medium, for example, oxides, sulfides, hydroxides, halides and other salts.

The phosphate ester having a fluoroalkyl group, a fluoroalkenyl group or a fluoroether group or its ammonium salt, alkali metal salt, alkaline earth metal salt or a salt with the metal compound may be represented by the following formulas:

$$(R_fR^2O)_jP(=O)(OR^1)_k(OH)_y(OM)_t \quad \text{(I)}$$

$$(R_fSO_2NR^3R^4O)_jP(=O)(OR^1)_k(OH)_y(OM)_t \quad \text{(II)}$$

wherein $R_f$ is $C_3$–$C_{21}$ fluoroalkyl, a $C_3$–$C_{21}$ fluoroalkenyl group or a $C_3$–$C_{21}$ fluoroether group, M is an alkali metal, an alkaline earth metal or other metal such as chromium, zirconium, titanium, aluminum, thallium or zinc, an ammonium group or a substituted ammonium group (examples of the substituents being a $C_1$–$C_5$ alkyl group or a $C_1$–$C_5$ alkoxy group), $R^1$ is a $C_1$–$C_5$ alkyl group, $R^2$ is a $C_1$–$C^{10}$ alkylene gr a group of the formula:

$$-CH_2CH(OR^5)CH_2-$$

in which $R^5$ is a hydrogen atom or a $C_1$–$C_{10}$ acyl group, $$-CH_2CH(OH)-,$$

$$-CONR^6-$$

in which $R^6$ is a $C_1$–$C_5$ alkyl group, $$-CH=CHCH_2- \text{ or}$$

$$-CH_2CHXCH_2-$$

in which X is a halogen atom, $R^3$ is a hydrogen atom or a $C_1$–$C_5$ alkyl group, $R^4$ is a $C_1$–$C_{10}$ alkylene group, j is 1, 2 or 3, y is 0, 1 or 2 but not larger than (j−1), k is 0, 1 or 2 but not larger than 3−(j+y), and t is 3−(j+y+k).

Specific examples of the compounds (I) and (II) are as follows:

$$CF_3CF_2(CF_2CF_2)_3CH_2CH_2OP(=O)(OH)(OCH_2CH_3)$$

$$(CF_3)_2CF(CF_2CF_2)_3CH_2CH(OH)CH_2OP(=O)(OH)_2$$

$$C_8F_{17}SO_2N(C_2H_5)CH_2CH_2OP(=O)(ONH_4)_2$$

$$(C_8F_{17}SO_2N(C_2H_5)CH_2CH_2O)_2P(=O)ONH_4$$

$$CF_3CF_2(CF_2CF_2)_3CH_2CH_2OP(=O)(OH)_2$$

The phosphonic acid derivative having a fluoroalkyl group, a fluoroalkenyl group or a fluoroether group and its reaction product with the metal compound are represented by the following formula:

$$R_fR^2PO(OR^1)_m(OH)_n(OM)_u \quad \text{(III)}$$

and

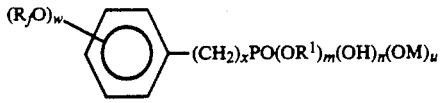

wherein $R_f$, $R^1$, $R^2$ and M are the same as defined above, w is 1 or 2, x is 1 or 2, m is 0, 1 or 2, n is 0, 1 or 2 but not larger than (2−m), and u is 2−(m+n).

Specific examples of the compounds (III) and (IV) are as follows:

$$CF_3CF_2(CF_2CF_2)_{2\text{-}8}CH_2CH_2P(=O)(OH)_2$$

$$C_8F_{17}CH_2CH_2P(=O)(OH)_2$$

$$(CF_3)_2CF(CF_2CF_2)_{2\text{-}4}CH_2CH_2P(=O)(OH)(ONa)$$

$$(CF_3)_2CF(CF_2CF_2)_{2\text{-}4}CH_2CH_2P(=O)(OH)_2$$

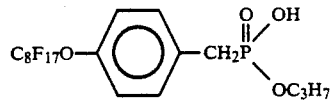

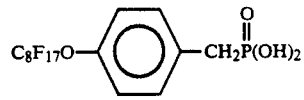

The phosphinic acid derivative having a fluoroalkyl group, a fluoroalkenyl group or a fluoroether group and its reaction product with the metal compound are represented by the following formula:

$$(R_fR^2)_p(H)_qP(OR^1)_r(OH)_s(OM)_v \quad \text{(V)}$$

and

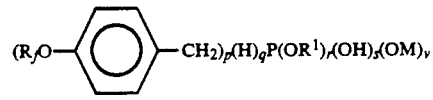

wherein $R_f$, $R^1$, $R^2$ and M are the same as defined above, p is 1 or 2, q is 2−p, s is 0 or 1, r is 0 or 1 but not larger than (1−r), and v is 1−(s+r).

Specific examples of the compounds (V) and (VI) are as follows:

$$[CF_3CF_2(CF_2CF_2)_{2\text{-}8}CH_2CH_2]_2P(=O)-OH$$

$$(C_8F_{17}CH_2CH_2)_2P(=O)-OH$$

-continued $$(C_{10}F_{21}CH_2CH_2)_2\overset{\overset{O}{\|}}{P}-OH$$

$$[(CF_3)_2CF(CF_2CF_2)_{2\text{-}4}CH_2CH_2)_2\overset{\overset{O}{\|}}{P}-OH$$

$$[(CF_3)_3C(CF_2CF_2)_{2\text{-}4}CH_2CH_2)_2\overset{\overset{O}{\|}}{P}-OH$$

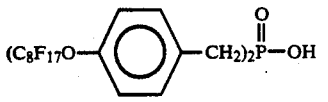

$$(C_8F_{17}O-\bigcirc-CH_2)_2\overset{\overset{O}{\|}}{P}-OH$$

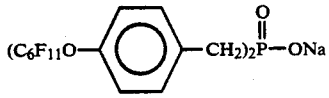

$$(C_6F_{11}O-\bigcirc-CH_2)_2\overset{\overset{O}{\|}}{P}-ONa$$

As the fluorine-containing carboxylic acid, a carboxylic acid of the formula:

$$R_f(CH_2)_nCOOH$$

wherein $R_f$ is the same as defined above, and n is a number of 0 to 10, or its salt such as an ammonium salt, alkali metal salts, alkaline earth salts, and salts with other metals (e.g. chromium, zirconium, titanium, aluminum, thallium, zinc, etc.). Among them, a chromium complex of perfluorooctanoic acid is preferred.

As the fluorine containing surfactant, compounds of the following formulas can be used:

$$R_fCH_2\overset{\overset{OH}{|}}{C}HCH_2\overset{\overset{CH_3}{|}}{N}CH_2COOK$$

$$R_fCH_2\overset{\overset{OH}{|}}{C}HCH_2\overset{\overset{CH_3}{|}}{N}{}^+(CH_2CH_2OH)_2I^-$$

$$R_fCH_2\overset{\overset{OH}{|}}{C}HCH_2NH(CH_2)_3-\overset{\overset{CH_3}{|}}{\underset{\underset{CH_3}{|}}{N}}{}^+-(CH_2)_2COO^-$$

$$R_fCH_2\overset{\overset{OH}{|}}{C}HCH_2O(CH_2CH_2O)_9CH_3$$

$$R_fCH_2\overset{\overset{OH}{|}}{C}HCH_2O(CH_2CH_2O)_9H$$

$$R_fCH_2\overset{\overset{OH}{|}}{C}HCH_2O(CH_2CH_2O)_8\overset{\overset{CH_3}{|}}{C}OC{=}CH_2$$

a copolymer of $$R_fCH_2\overset{\overset{OH}{|}}{C}HCH_2O(CH_2CH_2O)_8\overset{\overset{CH_3}{|}}{C}OC{=}CH_2 \text{ with}$$

$$HO(CH_2CH_2O)_8\overset{\overset{CH_3}{|}}{C}OC{=}CH_2.$$

In the leather treatment of the present invention, a weight ratio of the fatliquoring agent to the fluorine-containing oil is usually from 10:1 to 1:2, preferably from to 1:1.

In the leather treating process of the present invention, the fatliquoring agent is used in an amount of 1 to 30% by weight, preferably 2 to 10% by weight of the leather weight, and the fluorine-containing oil is used in an amount of 1 to 10% by weight, preferably 2 to 4% by weight of the leather weight.

When the tanned leather is treated with the leather treating agent containing the fatliquoring agent and the fluorine-containing oil which are usually present in an emulsion state, the treated tanned leather is excellent in touch and flexibility and is not discolored or faded by dry cleaning. Alternatively, when the tanned leather is fat-liquored with the fatliquoring agent alone and then treated with the fluorine-containing oil by, for example, spray coating or dipping, the same effects can be achieved.

According to the present invention, the touch, water resistance, water- and oil-repellency in a long term and washing resistance of the tanned leather are improved, and a deep color effect is achieved by a low refraction index of the fluorine-containing oil. Further, the tanned leather is not discolored or faded by dry cleaning, and flexibility, stain-proofness, shrink-proofness and non-swellability are improved.

PREFERRED EMBODIMENTS OF THE INVENTION

EXAMPLE 1

Preparation of a test composition

The fluoroalkyl group-containing phosphate and the perfluoropolyether as an oil were emulsified as follows:

A pH value of the predetermined amount of the fluoroalkyl group-containing phosphate was adjusted at 6.5 with 28 % aqueous ammonia while stirring. Thereto, a predetermined amount of the perfluoropolyether was added and thoroughly stirred. Thereafter, the mixture was emulsified by adding water slowly to obtain an emulsion (50 ml).

EXAMPLE 2

Treatment of a leather

A tanned leather was treated by a conventional wet processing method except that the compounds of the present invention were charged in a wet processing drum. That is, steps shown in Table 1 were carried out in a rotating drum. The washing steps were thoroughly done in flowing water. In the neutralizing steps, an aqueous solution of at least one neutralizing agent was charged in the drum in an about twice amount of the tanned leather, and then the drum was rotated at about 30° C. for 60 minutes to adjust pH of a bath at 5.5 to 6.0. The used neutralizing agents were sodium formate and sodium bicarbonate. Dyeing was carried out by charging a solution of 6% (based on the shaved leather weight) of Luganil Black NT (manufactured by BASF) and 100% of water in the drum, rotating the drum at 50° C. for 60 minutes, adding a 2% aqueous solution of formic acid and then further rotating the drum for 10 minutes to adjust pH at 3.5. Further, 3% of Luganil Black NT was added and the drum was rotated for 30 minutes. After draining the bath liquid, the leather was washed with water and retanned.

Retanning was done by rotating the leather in the drum containing a solution of 2% of Baychrom F and 100% of water at 30° C. for 90 minutes, followed by kept standing overnight. Then, the leather was washed with water and neutralized again in the same procedure as above, followed by washing with water and fatliquoring.

In the fatliquoring step, the emulsion prepared in Example 1 was used in the same manner as in the fatliquoring with the conventional fatliquoring agent. That is, predetermined amounts of the test compound and the conventional fatliquoring agent were added to water (100%) and charged in the drum. After rotating the drum at 50° C for 60 minutes, a 1.5% aqueous solution of formic acid was added and the drum was further rotated for 30 minutes. After draining the bath liquid, the leather was washed with water, horsed overnight, aired off, milled and then toggled.

The compounds used are as follows:

PRESENT INVENTION

Sample 1

5% of $R_f$—$OPO(OH)_2$+1% of Demnum S-200 (a perfluoropolyether manufactured by Daikin Industries Ltd.)

Sample 2

5% of $R_f'$—$OPO(OH)_2$+1% of Demnum S-200

Sample 3

5% of $R_f$—$OPO(OH)_2$+1% of Demnum terminals of which are modified with carboxyl groups Sample 4

5% of $R_f$—$OPO(OH)_2$+1% of Demnum terminals of which are modified with phosphate groups Sample 5

5% of $R_f$—$OPO(OH)_2$+1% of Daifloyl 10# (manufactured by Daikin Industries Ltd.)

Sample 6

5% of $R_f$—$OPO(OH)_2$+1% of Fomblin Y 25 having stabilized terminals

Sample 7

5% of $R_f$—$OPO(OH)_2$+1% of Fomblin Z DIAC terminals of which are modified with carboxyl groups Comparative compounds Sample 8

5% of $R_f$—$OPO(OH)_2$+1% of H2F (manufactured by Hoechst, neatsfoot oil)

Sample 9

5% of $R_f'$—$OPO(OH)_2$+1% of H2F

Sample 10

15% of Sincolin L (manufactured by Yoshikawa Oil Manufacturing Co., Ltd.)

Sample 11

5% of $R_f$—$OPO(OH)_2$ only

Sample 12

5% of $R_f''$—$OPO(OH)_2$ only

In the above formulas, $R_f$ is $(CF_3)_2CF(CF_2CF_2)_3$—$CH_2CH(OH)CH_2$—, and $R_f''$ is $CF_3CF_2(CF_2CF_2)_nCH_2CH_2$—.

TABLE 1

(% is based on the shaved leather weight)

1) Washing thoroughly in flowing water
2)
Neutralization: Sodium formate, 1.5%
Sodium bicarbonate, 1.5%
Water, 100%
pH, 6
Drum rotation for 60 minutes
3) Washing thoroughly in flowing water
4)
Dyeing: Luganil Black NT (BASF), 6%
Water, 100%
at 50° C.
Drum rotation for 60 minutes
Addition of 2% of formic acid Drum rotation for 10 minutes
Addition of 3 % of Luganil Black NT and drum rotation for 30 minutes
5) Washing thoroughly in flowing water
6) Retanning:
Baychrom F (Bayer AG), 2%
Water, 100%
Drum rotation at 30° C. for 90 minutes
(kept standing overnight)
7) Washing with water
8) Neutralization in the same manner as above
9) Washing with water
10) Fatliquoring:
Oil of the present invention
(predetermined amount)
Water, 100%
Drum rotation at 50° C. for 60 minutes
Addition of 1.5% of formic acid
Drum rotation for 30 minutes
11) Washing with water, dewatering and hang dry

EXAMPLE 3

Touch of each leather was evaluated by ten panels (five men and five women) according to following criteria:

5: Much softer than the leather treated with Sample 10
4: Softer than the leather treated with Sample 10
3: As soft as the leather treated with Sample 10
2: Harder than the leather treated with Sample 10
1 Much harder than the leather treated with Sample 10

The results are shown in Table 2.

TABLE 2

| Sample No. | Touch evaluation (average) |
|---|---|
| 1 | 4.3 |
| 2 | 4.9 |
| 3 | 4.9 |
| 4 | 4.9 |
| 8 | 3.9 |
| 9 | 3.8 |
| 10 | 3.0 |
| 11 | 3.7 |
| 12 | 3.1 |

EXAMPLE 4

Static water resistance test

According to JIS K 6550, hydraulic pressure of a column of water of 150 cm in height was applied to a leather piece, and a time at which three drops of water appear on the opposite surface (water drop appearing time). The same test was carried out at six different points. The results are shown in Table 3.

EXAMPLE 5

Color deepness before and after dry cleaning

According to JIS K 6552, each leather was dry cleaned by the method A (Perclene) or B (petroleum solvent). The color deepness was evaluated before and after the dry cleaning with the JIS discoloring gray scale by using the color deepness of the leather treated with Sample 8 or 9 before dry cleaning as the standard (Scale 5).

The results are shown in Table 3.

TABLE 3

| Sample No. | Water drop appearing time (sec.) | Color deepness before dry cleaning | Color deepness after | |
|---|---|---|---|---|
| | | | Method A | Method B |
| 1 | — | 4.5-5 | 4-5 | 4.5-5 |
| 2 | 111 | 4 | 3-4 | 4 |
| 3 | — | 4 | 3.5-4 | 5 |
| 4 | — | 5 | 5 | 5 |
| 5 | — | 4 | 3-4 | 3-4 |
| 6 | — | 4 | 3 | 3-4 |
| 7 | — | 4 | 3-4 | 4 |
| 8 | — | 5 | 2 | 3 |
| 9 | 63 | 5 | 1-2 | 2 |
| 10 | 9 | 5 | 1-2 | 2-3 |
| 11 | — | 2-3 | 1 | 2 |
| 12 | 59 | 1-2 | 1 | 1-2 |

What is claimed is:

1. A leather treatment composition comprising a fatliquoring agent and a fluorine-containing oil, wherein said fluorine-containing oil is at least one stable oil selected from the group consisting of a perfluoropolyether comprising repeating units of the formula:

$$-(\overset{\overset{\displaystyle CF_3}{|}}{C}FCF_2O)-,$$

a perfluoropolyether comprising repeating units of the formula:

$$-(\overset{\overset{\displaystyle CF_3}{|}}{C}FCF_2O)_p-(CF_2O)_q-(\overset{\overset{\displaystyle CF_3}{|}}{C}FO)_r-$$

wherein p, q and r are integers the sum of which is not smaller than 2 and not larger than 200, a poyfluoroether comprising repeating units of the formula:

$$-(CH_2CH_2CH_2O)_a-(CHClCF_2CF_2O)_b-(CCl_2CF_2CF_2O)_c-(CHFCF_2CF_2O)_d-(CFClCF_2CF_2O)_e-(CF_2CF_2CF_2)_f-$$

wherein a, b, c, d, e and f are 0 or positive integrs and satisfy the equations: $2 \leqq a+b+c+d+e+f \leqq 200$ and $a+c+d+f \geqq 1$, and a compound comprising repeating units of the formula:

$$[-(CF_2CFCl)_n-]-(CF_2CFCl)-$$

2. The leather treatment composition according to claim 1, wherein said fatliquoring agent is one having a functional group which is reactive with a metal compound contained in a tanned leather.

3. The leather treatment composition according to claim 1, wherein said fatliquoring agent is at least one selected from the group consisting of a phosphate ester,a phosphonic acid derivative and a phosphinic acid derivative having a fluoroalkyl group, a fluoroalkenyl groupof a fluoroether group, and their ammonium salt, alkali metal salts and alkaline earth metal salts and reaction products of said phosphate ester, phosphonic acid derivative or phosphinic acid derivative with a metal compound except the alkali and alkaline earth metals.

4. The leather treatment composition according to claim 3, wherein said phosphate ester having a fluoroalkylgorup, a fluoroalkenyl group or a fluoroether group or its ammonium salt, alkali metal salt, alkaline earth metal salt or a salt with the metal compound is a compound of the formula:

$$(R_fR^2O)_jP(\overset{\overset{\displaystyle O}{\|}}{O})(OR^1)_k(OH)_y(OM)_t \quad \text{(I)}$$

or $$(R_fSO_2NR^3R^4O)_jP(\overset{\overset{\displaystyle O}{\|}}{O})(OR^1)_k(OH)_y(OM)_t \quad \text{(II)}$$

wherein $R_f$ is $C_3$-$C_{21}$ fluoroalkyl, a $C_3$-$C_{21}$ fluoroalkenyl group or a $C_3$-$C_{21}$ fluoroether group, M is an alkali meal, an alkaline earth metal or other metal, an ammonium group or a substituted ammonium group, $R^1$ is a $C_1$-$C_5$ alkyl group, $R^2$ is a $C_1$-$C_{10}$ alkylene group or a group of the formula:

$$-CH_2CH(OR^5)CH_2-$$

in which $R^5$ is a hydrogen atom or a $C_1$-$C_{10}$ acyl group, $$-CH_2CH(OH)-,$$

$$-CONR^6-$$

in which $R^6$ is a $C_1$-$C_5$ alkyl group, $$-CH{=}CHCH_2- \text{ or}$$

$$-CH_2CHXCH_2-$$

in which X is a halogen atom, $R^3$ is a hydrogen atom or a $C_1$-$C_5$ alkyl group, $R^4$ is a $C_1$-$C_{10}$ alkylene group, j is 1, 2 or 3, y is 0, 1 or 2 but not larger than (3−j), k is 0, 1 or 2 but not larger than 3−(J+y), and t is 3−(j+y+k).

5. The leather treatment composition according to claim 4, wherein said phosphate ester or its salt is

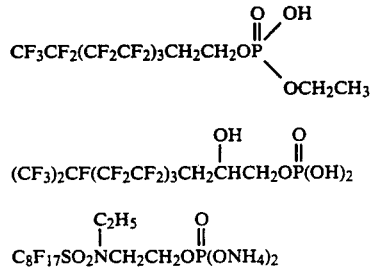

$$CF_3CF_2(CF_2CF_2)_3CH_2CH_2O\overset{\overset{\displaystyle O}{\|}}{P}(OH)(OCH_2CH_3)$$

$$(CF_3)_2CF(CF_2CF_2)_3CH_2\overset{\overset{\displaystyle OH}{|}}{C}HCH_2O\overset{\overset{\displaystyle O}{\|}}{P}(OH)_2$$

$$C_8F_{17}SO_2\overset{\overset{\displaystyle C_2H_5}{|}}{N}CH_2CH_2O\overset{\overset{\displaystyle O}{\|}}{P}(ONH_4)_2$$

-continued $$(C_8F_{17}SO_2\overset{\overset{C_2H_5}{|}}{N}CH_2CH_2O)_2\overset{\overset{O}{\|}}{P}ONH_4$$

or $$CF_3CF_2(CF_2CF_2)_3CH_2CH_2O\overset{\overset{O}{\|}}{P}(OH)_2$$

6. The leather treatment composition according to claim 3, wherein said phosphonic acid derivative having a fluoroalkyl group, a fluoroalkenyl group or a fluoroether group and its reaction product with the metal compound is a compound of the formula:

$$R_fR^2PO(OR^1)_m(OH)_n(OM)_u \quad \text{(III)}$$

or

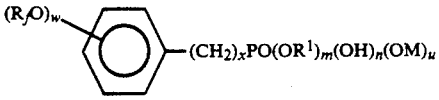

(IV)

wherein $R_f$, $R^1$, $R^2$ and M are the same as defined above, w is 1 or 2, x is 1 or 2, m is 0, 1 or 2, n is 0, 1 or 2 but not larger than (2−m), and u is 2−(m+n).

7. The leather treatment composition according to claim 6, wherein said phosphonic acid derivative or its salt is $$CF_3CF_2(CF_2CF_2)_{2\text{-}8}CH_2CH_2\overset{\overset{O}{\|}}{P}(OH)_2$$

$$C_8F_{17}CH_2CH_2\overset{\overset{O}{\|}}{P}(OH)_2$$

$$(CF_3)_2CF(CF_2CF_2)_{2\text{-}4}CH_2CH_2\overset{\overset{O}{\|}}{P}\begin{matrix}OH\\ONa\end{matrix}$$

$$(CF_3)_2CF(CF_2CF_2)_{2\text{-}4}CH_2CH_2\overset{\overset{O}{\|}}{P}(OH)_2$$

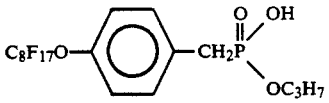

or

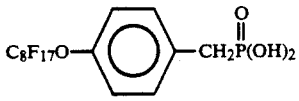

8. The leather treatment composition according to claim 3, wherein said phosphinic acid derivative having a fluoroalkyl group, a fluoroalkenyl group or a fluoroether group and its reaction product with the metal compound is a compound of the formula:

$$(R_fR^2)_p(H)_qP(OR^1)_r(OH)_s(OM)_v \quad \text{(V)}$$

and

-continued

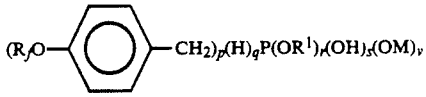

(VI)

wherein $R_f$, $R^1$, $R^2$ and M are the same as defined above, p is 1 or 2, q is 2−p, s is 0 or 1, r is 0 or 1 but not larger than (1−r), and v is 1−(s+r).

9. The leather treatment composition according to claim 8, wherein said phosphinic acid derivative or its salt is $$[CF_3CF_2(CF_2CF_2)_{2\text{-}8}CH_2CH_2]_2\overset{\overset{O}{\|}}{P}-OH$$

$$(C_8F_{17}CH_2CH_2)_2\overset{\overset{O}{\|}}{P}-OH$$

$$(C_{10}F_{21}CH_2CH_2)_2\overset{\overset{O}{\|}}{P}-OH$$

$$[(CF_3)_2CF(CF_2CF_2)_{2\text{-}4}CH_2CH_2)_2\overset{\overset{O}{\|}}{P}-OH$$

$$[(CF_3)_3C(CF_2CF_2)_{2\text{-}4}CH_2CH_2)_2\overset{\overset{O}{\|}}{P}-OH$$

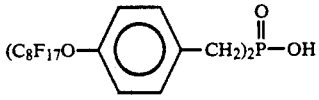

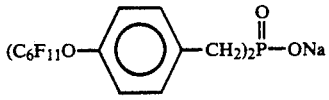

10. The leather treatment composition according to claim 1, wherein said fatliquoring agent is a fluorine-containing carboxylic acid of the formula:

$$R_f(CH_2)_nCOOH$$

wherein $R_f$ is the same as defined above, and n is a number of 0 to 10, or its salt.

11. The leather treatment composition according to claim 1, wherein said fluorine-containing oil is at least one selected from the group consisting of a perfluoropolyether comprising repeating units of the formula:

$$-(\overset{\overset{CF_3}{|}}{C}FCF_2O)_p-(CF_2O)_q-(\overset{\overset{CF_3}{|}}{C}FO)_r-$$

wherein p, q and r are integers the sum of which is not smaller than 2 and not larger than 209, and a polyfluoroether comprising repeating units of the formula:

$$-(CH_2CF_2CF_2O)_2-(CHClCF_2CF_2O)_b-(CCl_2CF_2CF_2O)_c-(CHFCF_2CF_2O)_d-(CFClCF_2CF_2O)_e-(CF_2CF_2CF_2)_f-$$

wherein a, b, c, d, e and f are 0 or positive integers and satisfy the equations: $2 \leqq a+b+c+d+e+f \leqq 200$ and $a+c+d+f \geqq 1$.

12. A process for treating leather, comprising treating leather with a leather treatment comprising a fatliquoring agent and a fluorine-containing oil, wherein said fluorine-containing oil is at least one stable oil selected from the group consisting of a perfluoropolyether comprising repeating units of the formula:

$$-(\overset{\overset{\displaystyle CF_3}{|}}{C}FCF_2O)-,$$

a perfluoropolyether comprising repeating units of the formula:

$$-(\overset{\overset{\displaystyle CF_3}{|}}{C}FCF_2O)_p-(CF_2O)_q-(\overset{\overset{\displaystyle CF_3}{|}}{C}FO)_r-$$

wherein p, q and r are integers the sum of which is not smaller than 2 and not larger than 200, a polyfluoroether comprising repeating units of the formula:

$$-(CH_2CF_2CF_2O)_a-(CHClCF_2CF_2O)_b-(CCl_2CF_2CF_2O)_c-(CHFCF_2CF_2O)_d-(CFClCF_2CF_2O)_e-(CF_2CF_2CF_2)_f-$$

wherein a, b, c, d, e and f are 0 are positive integers and satisfy the equations: $2 \leqq a+b+c+d+e+f \leqq 200$ and $a+c+d+f \geqq 1$, and a compound comprising repeating units of the formula:

$$[-(CF_2CFCl)_n-]-(CF_2CFCl)-$$

13. The process according to claim 12, wherein said fatliquoring agent is at least one selected from the group consisting of a phosphate ester, a phosphonic acid derivative and a phosphinic acid derivative having a fluoroalkyl group, a fluoroalkenyl group or a fluoroether group, and their ammonium salt, alkali metal salts and alkaline earth metal salts and reaction products of said phosphate ester, phosphonic acid derivative or phosphinic acid derivative with a metal compound except the alkali and alkaline earth metals.

14. The process according to claim 13, wherein said phosphate ester having a fluoroalkyl group, a fluoroalkenyl group or a fluoroether group or its ammonium salt, alkali metal salt, alkaline earth metal salt or a salt with the metal compound is a compound of the formula:

$$(R_fR^2O)_jP(=O)(OR^1)_k(OH)_y(OM)_t \quad \text{(I)}$$

or $$(R_fSO_2NR^3R^4O)_jP(=O)(OR^1)_k(OH)_y(OM)_t \quad \text{(II)}$$

wherein $R_f$ is $C_3$—$Ca_{21}$ fluoroalkyl, a $C_3$–$C_{21}$ fluoroalkenyl group or a $C_3$–$C_{21}$ fluoroether group, M is an alkali metal, an alkaline earth metal or other metal, an ammonium gorup or a substituted ammonium group, $R^1$ is a $C_1$–$C_5$ alkyl group, $R^2$ is a $C_1$–$C_{10}$ alkylene group or a group of the formula:

$$-CH_2CH(OR^5)CH_2-$$

in which $R^5$ is a hydrogen atom or a $C_1$–$C_{10}$ acyl group, $$-CH_2CH(OH)-,$$

$$-CONR^6-$$

in which $R^6$ is a $C_1$–$C_5$ alkyl group, $$-CH=CHCH_2- \text{ or}$$

$$-CH_2CHXCH_2-$$

in which X is a halogen atom, $R^3$ is hydrogen atom or a $C_1$–$C_5$ alkyl group, $R^4$ is a $C_1$–$C_{10}$ alkylene group, j is 1, 2 or 3, y is 0, 1 or 2 but not larger than $(j-1)$, k is 0, 1 or 2 but not larger than $3-(j+y)$, and t is $3-(j+y+k)$.

15. The process according to claim 14, wherein said phosphate ester or its salt is

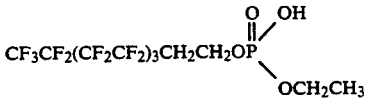

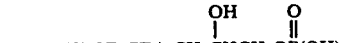

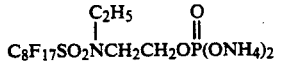

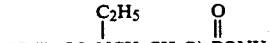

or

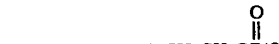

16. The process according to claim 13, wherein said phosphonic acid derivative having a fluoroalkyl group, a fluoroalkenyl group or a fluoroether group and its reaction product with the metal compound is a compound of the formula:

$$R_fR^2PO(OR^1)_m(OH)_n(OM)_u \quad \text{(III)}$$

or

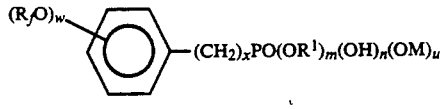

(IV)

wherein $R_f$, $R^1$, $R^2$ and M ar the same as defined above, w is 1 or 2, x is 1 or 2, m is 0, 1 or 2, n is 0, 1 or 2 but not larger than $(2-m)$, and u is $2-(m+n)$.

17. The process according to claim 16, wherein said phosphonic acid derivative or its salt is

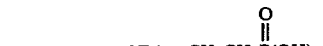

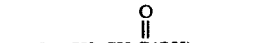

-continued

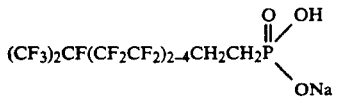

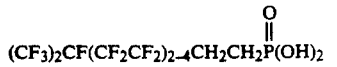

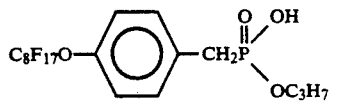

or

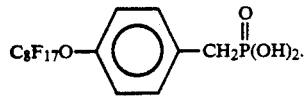

18. The process according to claim 13, wherein said phosphinic acid derivative having a fluoroalkyl group, a fluoroalkenyl group or a fluoroether group and its reaction product with the metal compound is a compound of the formula:

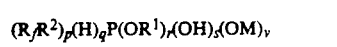

(V)

or

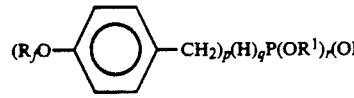

(VI)

wherein $R_f$, $R^1$, $R^2$ and M are the same as defined above, p is 1 or 2, q is 2−p, s is 0 or 1, r is 0 or 1 but not larger than (1−r), and v is 1−(s+r).

19. The process according to claim 18, wherein said phosphinic acid derivative or its salt is

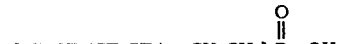

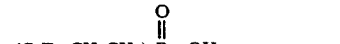

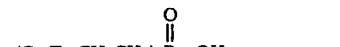

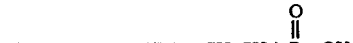

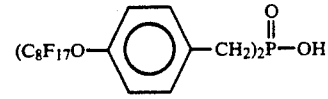

or

-continued

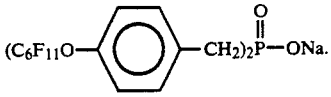

20. The process according to claim 12, wherein said fatliquoring agent is a fluorine-containing carboxylic acid of the formula:

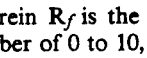

wherein $R_f$ is the same as defined above, and n is a number of 0 to 10, or its salt.

21. The process for treating leather according to claim 12, wherein said fluorine-containing oil is at least one selected from the group consisting of a perfluoropolyether comprising repeating units of the formula:

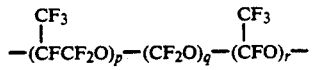

wherein p, q and r are integers the sum of which is not smaller than 2 and not larger than 200, and a polyfluoroether comprising repeating units of the formula:

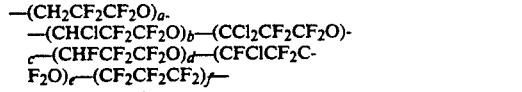

wherein a, b, c, d, e and f are 0 or positive integers and satisfy the equations: $2 \leqq a+b+c+d+e+f \leqq 200$ and $a+c+d+f \geqq 1$.

22. A process for treating a leather comprising fatliquoring a leather and then treating a fatliquored leather with a leather treatment composition which comprises a fluorine-containing oil.

23. The process according to claim 22, wherein said fluorine-containing oil is at least one stable oil selected from the group consisting of a perfluoropolyether comprising repeating units of the formula:

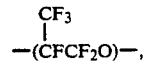

a perfluoropolyether comprising repeating units of the formula:

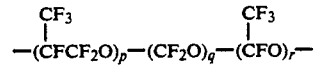

wherein p, q and r are integers a sum of which is not smaller than 2 and not larger than 200, a polyfluoroether comprising repeating units of the formula:

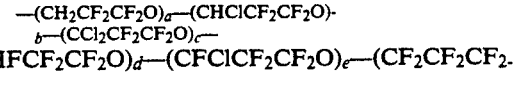

wherein a, b, c, d, e and f are 0 or positive integers and satisfy the equations: $2 \leqq a+b+c+d+e+f \leqq 200$ and $a+c+d+f \geqq 1$, and a compound comprising repeating units of the formula:

$-(CF_2CFCl)-$

24. The process according to claim 22, wherein said fatliquoring agent is at least one selected from the group consisting of a phosphate ester, a phosphonic acid derivative and a phosphinic acid derivative having a fluoroalkyl group, a fluoroalkenyl group or a fluoroether group, and their ammonium salt, alkali metal salts and alkaline earth metal salts and reaction products of said phosphate ester, phosphonic acid derivative or phosphinic acid derivative with a metal compound except the alkali and alkaline earth metals.

25. The process according to claim 24, wherein said phosphate ester having a fluoroalkyl group, a fluoroalkenyl group or a fluoroether group or its ammonium salt, alkali metal salt, alkaline earth metal salt or a salt with the metal compound is a compound of the formula:

$$(R_fR^2O)_jP(=O)(OR^1)_k(OH)_y(OM)_t \quad \text{(I)}$$

or $$(R_fSO_2NR^3R^4O)_jP(=O)(OR^1)_k(OH)_y(OM)_t \quad \text{(II)}$$

wherein $R_f$ is $C_3$—$C_{21}$ fluoroalkyl, a $C_3$-$C_{21}$ fluoroalkenyl group or a $C_3$-$C_{21}$ fluoroether grup, M is an alkali metal, an alkaline earth metal or other metal, an ammonium gorup or a substituted ammonium group, $R^1$ is a $C_1$-$C_5$ alkyl group, $R^2$ is a $C_1$-$C_{10}$ alkylene group or a group of the formula:

$$-CH_2CH(OR^5)CH_2-$$

in which $R^5$ is a hydrogen atom or a $C_1$-$C_{10}$ acyl group, $$-CH_2CH(OH)-,$$

$$-CONR^6-$$

in which $R^6$ is a $C_1$-$C_5$ alkyl group, $$-CH{=}CHCH_2- \text{ or}$$

$$-CH_2CHXCH_2-$$

in which X is a halogen atom, $R^3$ is a hydrogen atom or a $C_1$-$C_5$ alkyl group, $R^4$ is a $C_1$-$C_{10}$ alkylene group, j is 1, 2 or 3, y is 0, 1 or 2 but not larger than (j−1), k is 0, 1 or 2 but not larger than 3−(j+y), and t is 3−(j+y+k).

26. The process according to claim 25, wherein said phosphate ester or its salt is $$CF_3CF_2(CF_2CF_2)_3CH_2CH_2OP(=O)(OH)(OCH_2CH_3)$$

$$(CF_3)_2CF(CF_2CF_2)_3CH_2CH(OH)CH_2OP(=O)(OH)_2$$

$$C_8F_{17}SO_2N(C_2H_5)CH_2CH_2OP(=O)(ONH_4)_2$$

-continued $$(C_8F_{17}SO_2N(C_2H_5)CH_2CH_2O)_2P(=O)ONH_4$$

or $$CF_3CF_2(CF_2CF_2)_3CH_2CH_2OP(=O)(OH)_2.$$

27. The process according to claim 24, wherein said phosphonic acid derivative having a fluoroalkyl group, a fluoroalkenyl group or a fluoroether group and its reaction product with the metal compound is a compound of the formula:

$$R_fR^2PO(OR^1)_m(OH)_n(OM)_u \quad \text{(III)}$$

or

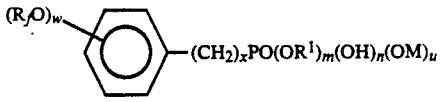

(IV)

wherein $R_f$, $R^1$, $R^2$ and M are the same as defined above, w is 1 or 2, x is 1 or 2, m is 0, 1 or 2, n is 0, 1 or 2 but not larger than (2−m), and u is 2−(m+n).

28. The process according to claim 27, wherein said phosphonic acid derivative or its salt is $$CF_3CF_2(CF_2CF_2)_{2-8}CH_2CH_2P(=O)(OH)_2$$

$$C_8F_{17}CH_2CH_2P(=O)(OH)_2$$

$$(CF_3)_2CF(CF_2CF_2)_{2-4}CH_2CH_2P(=O)(OH)(ONa)$$

$$(CF_3)_2CF(CF_2CF_2)_{2-4}CH_2CH_2P(=O)(OH)_2$$

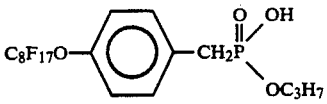

or

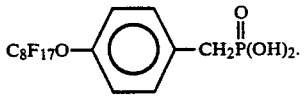

29. The process according to claim 24, wherein said phosphinic acid derivative having a fluoroalkyl group, a fluoroalkenyl group or a fluoroether group and its reaction product with the metal compound is a compound of the formula:

$$(R_fR^2)_p(H)_qP(OR^1)_r(OH)_s(OM)_v \quad \text{(V)}$$

or

-continued (VI)

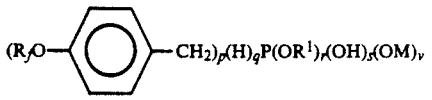

wherein $R_f$, $R^1$, $R^2$ and M are the same as defined above, p is 1 or 2, q is 2−p, s is 0 or 1, r is 0 or 1 but not larger than (1−r), and v is 1−(s+r).

30. The process according to claim 29, wherein said phosphinic acid derivative or its salt is

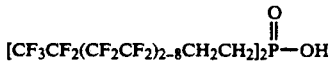

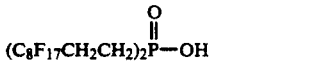

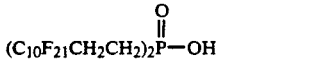

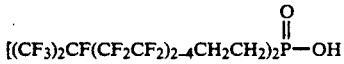

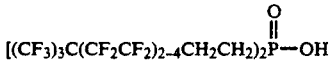

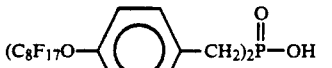

or

-continued

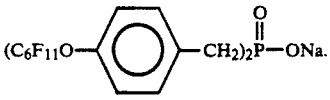

31. The process according to claim 22, wherein said fatliquoring agent is a fluorine-containing carboxylic acid of the formula:

$$R_f(CH_2)_nCOOH$$

wherein $R_f$ is the same as defined above, and n is a number of 0 to 10, or its salt.

32. The process for treating leather according to claim 23, wherein said fluorine-containing oil is at least one selected from the group consisting of a perfluoropolyether comprising repeating units of the formula:

$$-(\overset{CF_3}{\overset{|}{C}}FCF_2O)_p-(CF_2O)_q-(\overset{CF_3}{\overset{|}{C}}FO)_r-$$

wherein p, q and r are integers the sum of which is not smaller than 2 and not larger than 200, and a polyfluoroether comprising repeating units of the formula:

$$-(CH_2CF_2CF_2O)_a-(CHClCF_2CF_2O)_b-(CCl_2CF_2CF_2O)_c-(CHFCF_2CF_2O)_d-(CFClCF_2CF_2O)_e-(CF_2CF_2CF_2)_f-$$

wherein a, b, c, d, e and f are 0 or positive integers and satisfy the equations: $2 \leqq a+b+c+d+e+f \leqq 200$ and $a+c+d+f \geqq 1$.

* * * * *